US009393458B1

(12) United States Patent
LaCaze

(10) Patent No.: US 9,393,458 B1
(45) **Date of Patent: *Jul. 19, 2016**

(54) ROTATIONAL RESISTANCE SYSTEM

(71) Applicant: John Joseph LaCaze, Opelousas, LA (US)

(72) Inventor: John Joseph LaCaze, Opelousas, LA (US)

(73) Assignee: Blu Sky Solutions, LLC (DBA Rotex), Opelousas, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/920,905

(22) Filed: Oct. 23, 2015

Related U.S. Application Data

(63) Continuation-in-part of application No. 14/711,539, filed on May 13, 2015, now Pat. No. 9,295,873.

(60) Provisional application No. 62/126,461, filed on Feb. 28, 2015.

(51) Int. Cl.

| | |
|---|---|
| ***A63B 23/08*** | (2006.01) |
| ***A63B 23/10*** | (2006.01) |
| ***A63B 21/045*** | (2006.01) |
| ***A63B 21/04*** | (2006.01) |
| ***A63B 22/14*** | (2006.01) |
| ***A63B 21/22*** | (2006.01) |
| ***A63B 21/00*** | (2006.01) |
| ***A63B 21/02*** | (2006.01) |

(52) U.S. Cl.
CPC ..... *A63B 21/22* (2013.01); *A63B 21/00069* (2013.01); *A63B 21/023* (2013.01); *A63B 21/0435* (2013.01); *A63B 22/14* (2013.01)

(58) Field of Classification Search
CPC ..... A63B 21/00069; A63B 21/00072; A63B 21/00076; A63B 21/023; A63B 21/025; A63B 21/04; A63B 21/0407; A63B 21/0435; A63B 21/045; A63B 21/0455; A63B 21/1465; A63B 21/1496; A63B 21/22; A63B 22/14; A63B 22/18; A63B 22/185; A63B 23/02; A63B 23/0205; A63B 23/0216; A63B 23/0482; A63B 2023/003; A63B 26/003
USPC ..... 482/147
See application file for complete search history.

(56) References Cited

U.S. PATENT DOCUMENTS

| | | | | |
|---|---|---|---|---|
| 4,200,282 | A * | 4/1980 | Agyagos | A63B 17/00 482/147 |
| 4,319,749 | A * | 3/1982 | Agyagos | A63B 22/14 482/147 |
| 4,679,550 | A * | 7/1987 | Quam | A61H 15/00 482/79 |
| 4,953,858 | A | 9/1990 | Zelli | 482/147 |
| 5,518,476 | A | 5/1996 | McLeon | |
| 6,176,817 | B1 | 1/2001 | Carey et al. | |
| 7,621,861 | B1 | 11/2009 | Kalember et al. | |

(Continued)

*Primary Examiner* — Oren Ginsberg
(74) *Attorney, Agent, or Firm* — Matthew J. Lattig; Charter IP, LLC

(57) ABSTRACT

A rotational resistance system is described herein, the system being adapted for a user so as to facilitate exercise of muscles throughout upper and lower extremities of the user's body. The system may include a pair of separate rotational resistance devices in side-by-side relation for placement of a corresponding hand or foot of a user thereon. Each device may further include a support structure, a top surface of which being a rotatable plate, the plate connected to a means for providing resistance and release of resistance thereto. Use of various exercise protocols with the system activates selected under active muscles of the user and releases selected overactive muscles.

20 Claims, 8 Drawing Sheets

(56) References Cited

U.S. PATENT DOCUMENTS

| | | | | |
|---|---|---|---|---|
| 7,909,747 | B1 | 3/2011 | LaCaze | |
| 9,295,873 | B1 * | 3/2016 | LaCaze | A63B 21/22 |
| 2007/0027009 | A1 | 2/2007 | Arnold | |
| 2011/0287914 | A1 | 11/2011 | Morris | 482/147 |
| 2011/0312479 | A1 | 12/2011 | Caponigro | 482/147 |
| 2012/0225741 | A1 | 9/2012 | Antolick | 473/452 |

* cited by examiner

ROTATIONAL RESISTANCE SYSTEM

CROSS-REFERENCE TO RELATED APPLICATIONS

The present application claims the benefit under 35 U.S.C. §120 of U.S. patent application Ser. No. 14/711,539 to the inventor, filed May 13, 2015, pending, which in turn claims the benefit under 35 U.S.C. §119(e) of U.S. Provisional Patent Application Ser. No. 62/126,461 to the inventor, filed Feb. 28, 2015. The entire contents of each application is hereby incorporated by reference herein.

BACKGROUND

1. Field

The example embodiments in general are directed to a rotational exercise system, more particularly to a system adapted for warm-up/activation before and recovery after exercise, rehabilitation from injury, functional training, and performance, the system additionally adapted to reduce the likelihood of incontinence in a user's body, and further adapted to enhance a user's range of motion.

2. Related Art

Various types of conventional exercise and/or therapy devices have been developed to provide an effective means for supplying resistance and movement to a person's body for keeping fit by working out against a given resistance, either self-imposed, with an external force, or via rotation. Typically, these conventional exercise devices are configured so as to exercise or rehabilitate different parts of the human body using some type of force, sometimes in the form of weights and/or energy creating resistance. Movable belt devices also create a stationary running platform.

FIG. 1 is a perspective view of a conventional exercise and therapy device. Referring to FIG. 1, the device 10 includes a base 12 (i.e., a dish exercise and therapy platform) having an upper flat surface 14, and a plurality of ball bearings 22 movably held within respective bearing housings 32. The device 10 also includes a bearing support base 52 having a plurality of support blocks 42, 44. The blocks 42, 44 are fixedly attached thereto and to the ball bearing housings 32 so as to be held in place above the flat surface 14 of the base 12. The device 10 has a circular dish-shaped platform means with its curved lower surface 16 in contact with the ball bearings 22. The circular platform means is rotatably placed upon the ball bearings 22 and readily moved in the horizontal and vertical directions when any force is exerted upon its flat upper surface 14.

Device 10 further includes a tensioning mechanism 50 consisting of an upper coated tensioning cable 62, held close to a hand rail 76 by one or more cable retaining straps 66, an upper tensioning cable retaining bracket 68, notched tensioning adjustment mechanism 72, and tensioning adjustment mechanism handle 74. A safety feature for device 10 is served by the hand rail 76 and the removable stationary step platform 82.

When the tensioning adjustment mechanism handle 74 is placed in the notch at a position furthest away from the upper tensioning cable retaining bracket 68, the greatest amount of tension is placed upon base 12 at the distal end of the tensioning mechanism 50. Accordingly, base 12 is essentially set motionless at this setting, allowing the user to safely move onto and off the removable stationary step platform 82, as well as onto and off, the rotatable exercise and therapy platform (base 12).

FIG. 2 is a partial isometric view of another conventional rotational exercise apparatus. The exercise apparatus 110 is designed to strengthen and tone the human body and includes a collapsible stationary support frame 120 with horizontal gripping arms 122, and a base plate 152 attached in a horizontal position to the frame 120. A rotatable platform 154 is positioned atop base plate 152 and freely rotates with a pair of swiveling foot plates 156 mounted on the platform upper surface. During use, a person places their foot on each foot plate 156 and exercises by rotating and counter rotating both the platform 154 and the foot plates 156 simultaneously, while maintaining balance by holding onto the gripping arms 122.

The inventor's own patent (U.S. Pat. No. 7,909,747, issued Mar. 22, 2011 and entitled "Exercise Device and Method", hereafter the "'747 patent") in general is directed to a method and device for exercise of the gluteus medius and gluteus minimus muscle complex against resistance in internal rotation, the tibialis posterior in internal rotation and inversion, the piriformis muscle and its synergists in external rotation, and the peroneal muscles in external rotation and eversion.

FIG. 3 is a front perspective exploded view of another conventional exercise device (as shown and described in the inventor's '747 patent) which imparts resistance to rotational movement. Referring to FIG. 3, the device 200 includes a base 212, a rotatable foot support plate 216 mounted on the base 212 at an angle (see tilted top 214) and having a resistance to rotation, and an elevated foot support plate 224 mounted on the base 212 at a position forward and to the side of the rotatable foot support 216. The elevated foot support plate 224 provides a foot support surface elevated above the rotatable foot support plate 216.

The device 200 further includes a back support 222 that is selectively positioned horizontally, toward and away from the base 212, and handrails 220 connected to the base 212. Accordingly, device 200 provides internal and external resistance to isolate and exercise the gluteus medius and gluteus minimus muscle complex or the *piriformis* and synergists while the user is in a standing position, and also provides internal and external resistance to exercise the tibialis posterior and the peroneals in either the standing or seated position.

In the '747 patent, only one muscle area complex is actually addressed, that which is key in providing gains to the hips and lower back. Additionally, the back support 222 described in the '747 patent is an essential part of the exercise program. Further, device 200 employs a generally cumbersome means 236 of providing a smooth resistance and release of resistance. Specifically, rotational resistance is supplied in both directions of rotation via a system of tension springs, coil springs, hydraulic or pneumatic cylinders, a system of cams and springs, or a system of disks and brakes to provide rotating resistance to the rotatable foot plate 216. Moreover, front foot support plate 224 serves as an integral part of the exercise protocol.

Consequently, in light of some of the limitations described above, there is a significant need for a rotational resistance device which does not require a back support and/or a front foot support plate as an integral part of the exercise protocol, and which does not require the above-noted cumbersome means of providing smooth resistance and release of resistance. Further, there is a need for a device that provides the user an ability to exercise most if not all the muscles in the body, including but not limited to muscles in an around the lower back, hips, core, knees, ankles, shoulders, elbows, and wrist.

SUMMARY

An example embodiment is directed to a rotational resistance system. The system may include a pair of separate rotational resistance devices arranged in side-by-side relation on a ground surface next to a wall. Each device may further include a rotatable foot plate thereon and internal resistance means therein for providing resistance and release of resistance against rotation of the plate, each plate adapted so that a user, with a corresponding foot on each device and their back being supported by the wall, performs a hip rotation exercise to activate selected under active muscles and release selected overactive muscles.

Another example embodiment is directed to a system including a pair of separate rotational resistance devices arranged in side-by-side relation on a ground surface next to a wall. Each device may further include a rotatable foot plate thereon and internal resistance means therein for providing resistance and release of resistance against rotation of the plate, each plate adapted so that a user, with a corresponding foot on each device and their back being supported by the wall, performs an exercise to activate selected under active muscles and release selected overactive muscles in an around the pelvic bone so as to strengthen muscular support of the bladder in the user's body.

Another example embodiment is directed to a rotational resistance system including a pair of separate rotational resistance devices arranged in side-by-side relation on a ground surface next to a wall. Each device may further include a rotatable foot plate connected to a means for providing resistance and release of resistance as a user, with a corresponding foot on each device and their back being supported by the wall, performs a squat-type exercise to activate selected under active muscles and release selected overactive muscles.

Another example embodiment is directed to a rotational resistance system including a pair of separate rotational resistance devices arranged in side-by-side relation on a ground surface. Each device may further include a rotatable plate connected to a means for providing resistance and release of resistance as a user, with a corresponding hand on each device and in a kneeling position on the ground surface, performs a shoulder rotation exercise to activate selected under active muscles and release selected overactive muscles.

Another example embodiment is directed to a rotational resistance system for improving a user's range of motion. The system may include an elongate member adapted to be held between crossed arms of the user against their chest, and a pair of separate rotational resistance devices arranged in opposite facing relation to one another on a ground surface. Each device may further include a rotatable plate connected to a means for providing resistance and release of resistance as a user, holding the member with a corresponding foot on each plate and in a bent knee position with upper body leaning slightly forward at the trunk, performs an exercise based on rotation of their trunk maximally to either direction, with inward foot rotation on each side of rotation, to activate selected under active muscles and release selected overactive muscles, thereby enhancing range of motion.

Another example embodiment is directed to a rotational resistance system adapted for a user so as to facilitate exercise of muscles throughout upper and lower extremities of the user's body. The system includes a pair of separate rotational resistance devices for placement of a corresponding hand or foot of a user thereon. Each device further includes a support structure, a top surface of which is embodied as a rotatable plate. The plate is connected to a means for providing resistance and release of resistance thereto. Performance of various exercise protocols by the user with the system activates selected under active muscles of the user and releases selected overactive muscles to inherently effect myofascial balance therebetween.

BRIEF DESCRIPTION OF THE DRAWINGS

Example embodiments will become more fully understood from the detailed description given herein below and the accompanying drawings, wherein like elements are represented by like reference numerals, which are given by way of illustration only and thus are not limitative of the example embodiments herein.

DETAILED DESCRIPTION

Figure 2:
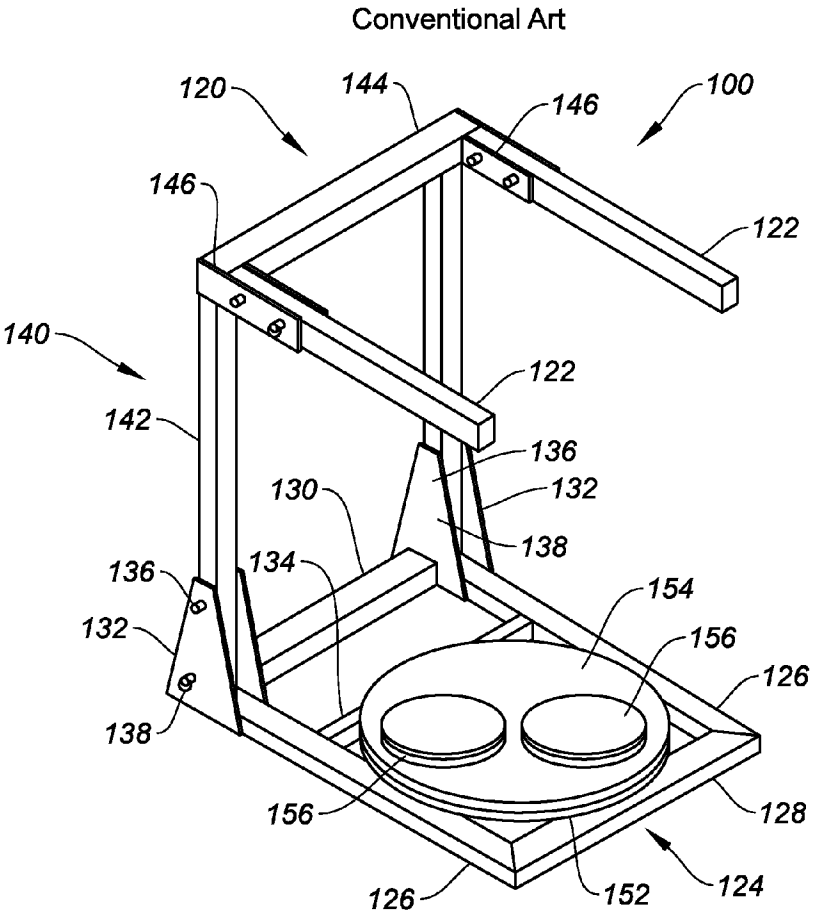
FIG. 2 is a partial isometric view of another conventional rotational exercise apparatus.
Figure 1:
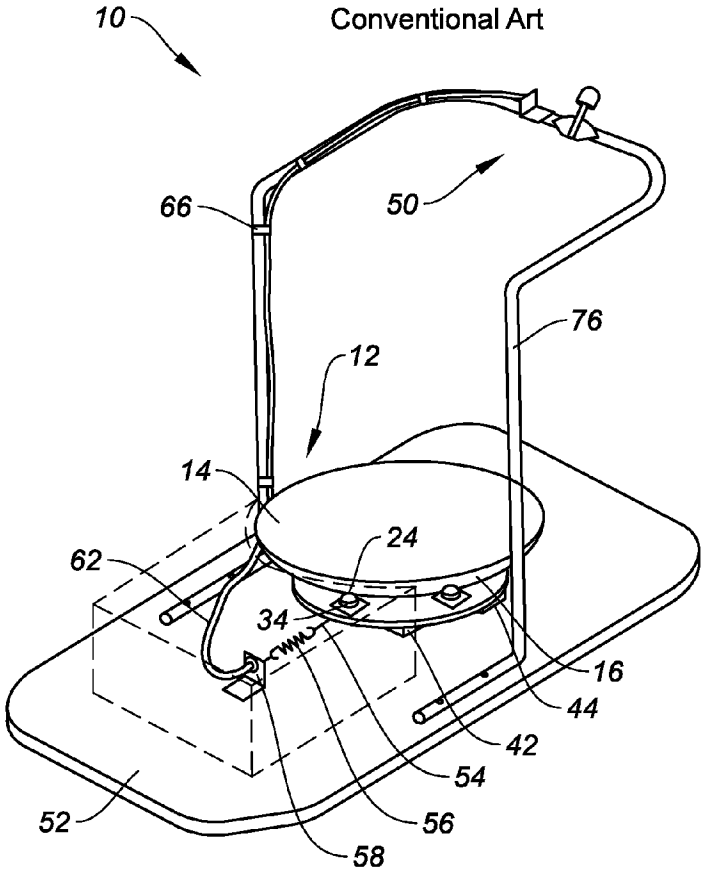
FIG. 1 is a perspective view of a conventional exercise and therapy device.
Figure 4:
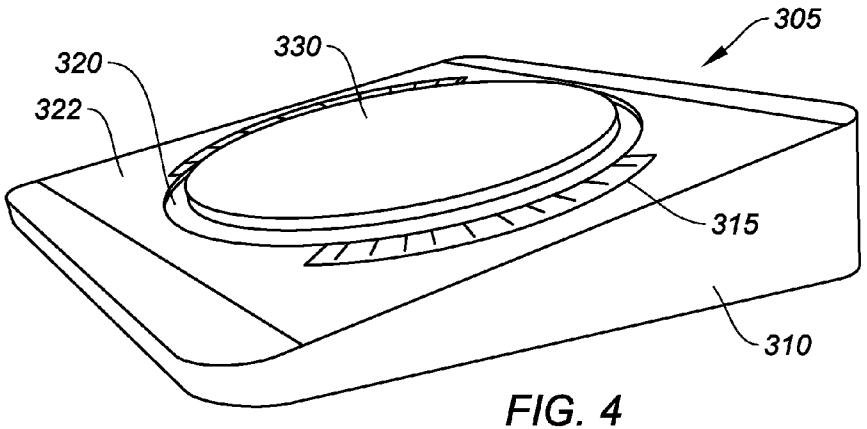
FIG. 4 is a perspective view of a rotational resistance device of the system, according to an example embodiment.
Figure 5:
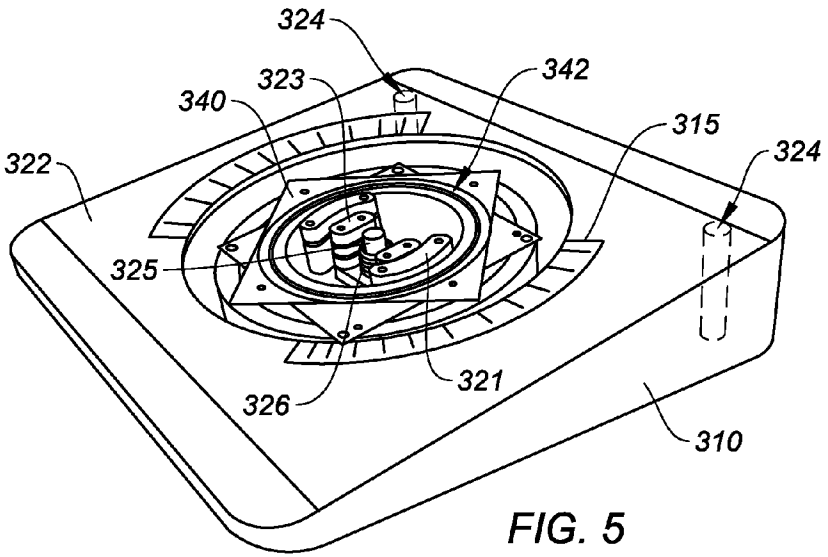
FIG. 5 is a perspective view of the device of FIG. 4 with selected structure removed to illustrate the turntable in more detail.
Figure 3:
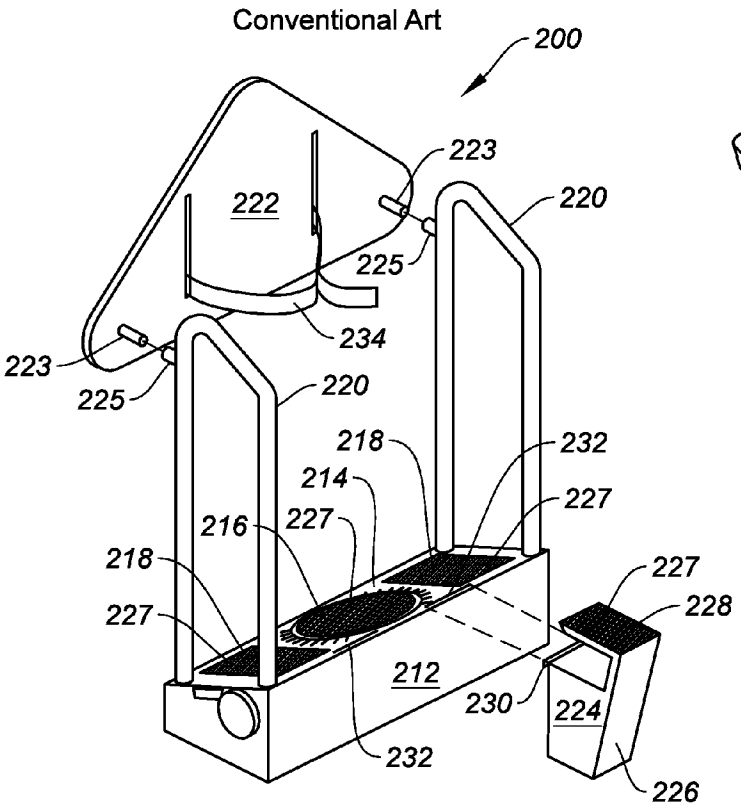
FIG. 3 is a front perspective exploded view of another conventional exercise device which imparts resistance to rotational movement.
Figure 6:
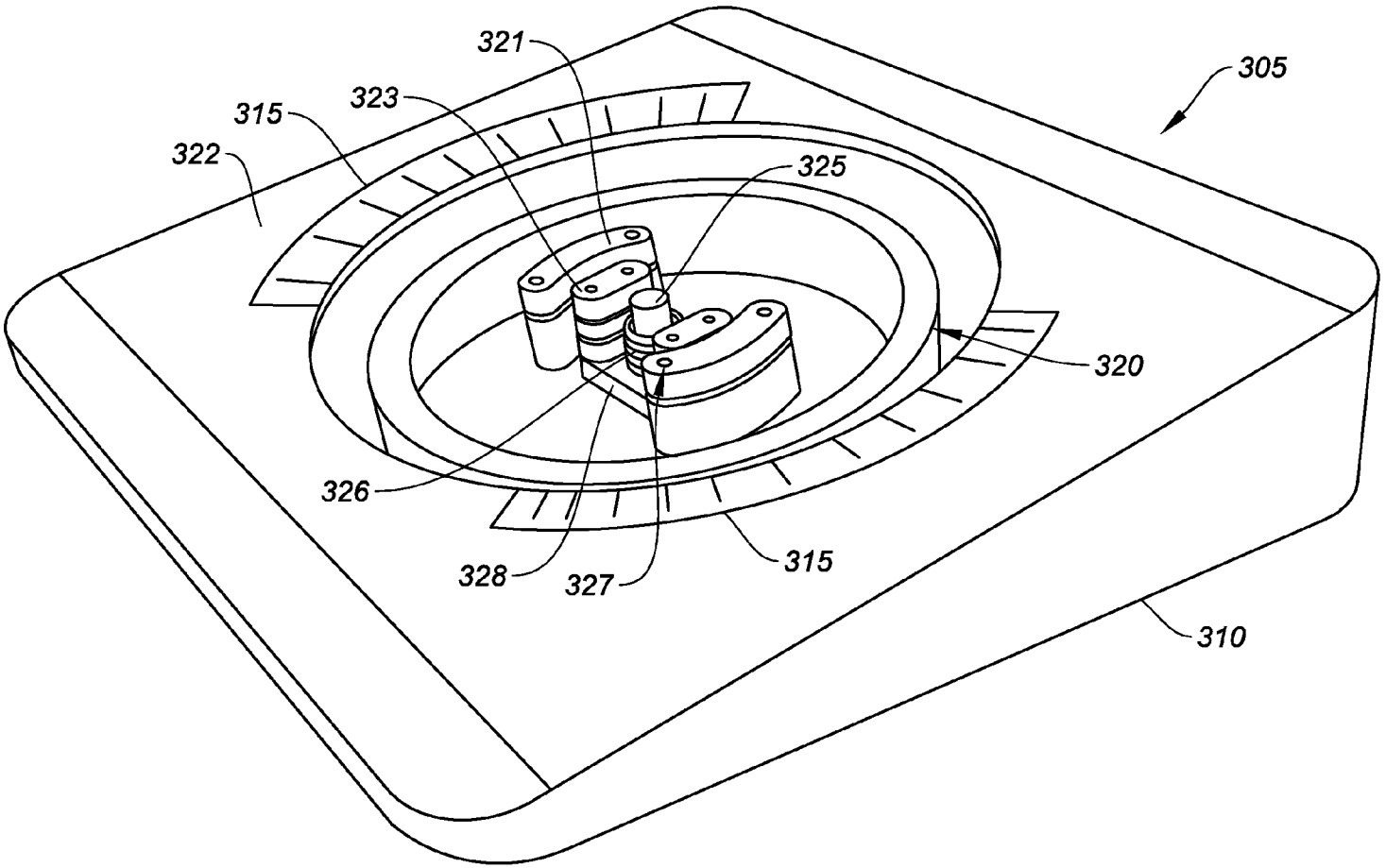
FIG. 6 is a perspective view of the device of FIG. 4 with selected structure removed to illustrate mounting structure and the spring in more detail.

In the following description, certain specific details are set forth in order to provide a thorough understanding of various example embodiments of the disclosure. However, one skilled in the art will understand that the disclosure may be practiced without these specific details. In other instances, well-known structures associated with manufacturing techniques have not been described in detail to avoid unnecessarily obscuring the descriptions of the example embodiments of the present disclosure.

Unless the context requires otherwise, throughout the specification and claims that follow, the word "comprise" and variations thereof, such as "comprises" and "comprising," are to be construed in an open, inclusive sense, that is, as "including, but not limited to."

Reference throughout this specification to "one example embodiment" or "an embodiment" means that a particular feature, structure or characteristic described in connection with the embodiment is included in at least one embodiment.

Thus, the appearances of the phrases "in one example embodiment" or "in an embodiment" in various places throughout this specification are not necessarily all referring to the same embodiment. Further, the particular features, structures or characteristics may be combined in any suitable manner in one or more example embodiments.

As used in this specification and the appended claims, the singular forms "a," "an," and "the" include plural referents unless the content clearly dictates otherwise. The term "or" is generally employed in its sense including "and/or" unless the content clearly dictates otherwise.

As used in the specification and appended claims, the terms "correspond," "corresponds," and "corresponding" are intended to describe a ratio of or a similarity between referenced objects. The use of "correspond" or one of its forms should not be construed to mean the exact shape or size. In the drawings, identical reference numbers identify similar elements or acts. The size and relative positions of elements in the drawings are not necessarily drawn to scale.

In general, an example rotational resistance system ("system 300") as to be described in more detail hereafter is adapted, in one example, for use against a flat surface such as a wall. Not only does the wall assist with balance and support for the user, but it also serves as a brace so that the user may selectively add sufficient resistance to the rotation of the device while maintaining their trunk and core stable (which cannot be accomplished otherwise). Example target areas which may be exploited by a user of the example rotational resistance device for exercise may include but are not limited to the muscles in and around the lower back, hips, core, spine, knees, ankles, shoulders, elbows, and wrists. The example rotational resistance system 300 is specifically adapted to the user based on physiology and biomechanics principles in order to facilitate injury prevention and rehabilitation after injury. Additionally, the example rotational resistance system 300 may be employed away from the wall to work shoulder, upper back, trunk, hip and leg muscles, as well as to increase the overall range of motion of the user's body. Further, and as will be described in further detail below, the system 300 may be employed to assist a user thereof as an incontinence reduction measure.

Before discussing the example embodiments in detail, an understanding of the skeletal muscles in the body is provided. Skeletal muscle is made up of bundles of individual muscle fibers called myocytes. Each myocyte contains many myofibrils, which are strands of proteins (actin and myosin) that can grab on to each other and pull. This shortens the muscle and causes muscle contraction. Muscle contractions occur when a muscle fiber or group of fibers is activated by a nerve to increase the tension within the muscle.

The human muscles are made of bundles of muscle fibers that contain thousands of smaller structures called myofibrils, where the actual contraction occurs. Within myofibrils, there are two types of filaments, called actin and myosin. The sliding filament theory explains that when a muscle is activated and movement occurs, these two interlocking filaments can grab onto each other and pull, which causes the myofibril to shorten. This shortening is called a muscle contraction.

There are three ways a muscle fiber can be activated, e.g., three types of muscle contractions. Two allow for movement in the muscle and one simply creates tension, without joint movement. The three contraction types include: concentric muscle contraction (shortening); eccentric muscle contraction (lengthening); and isometric muscle contraction (static). It is generally accepted that muscle fiber types may be broken down into two main types: (a) slow twitch (Type I) muscle fibers; and (b) fast twitch (Type II) muscle fibers. Fast twitch fibers can be further categorized into Type IIa and Type IIb fibers.

A slow-twitch or Type I muscle fiber can be understood as a muscle fiber that develops less tension more slowly than a fast-twitch fiber. The slow-twitch fiber is usually fatigue resistant and has adequate oxygen and enzyme activity. Studies indicate that world-class endurance runners apparently have high percentages of slow-twitch fibers, known as "red muscle" due to the abundance of capillaries serving the fiber muscle. This muscle type also has high amounts of the protein myoglobin, which functions to store oxygen inside the muscle cell. This, slow-twitch muscles are more efficient at using oxygen to generate more fuel (known as "ATP") for continuous, extended muscle contractions over a long period of time. Slow-twitch fibers fire more slowly than fast-twitch fibers and can go a long time before fatigue. Accordingly, slow-twitch fibers are great at helping athletes run marathons or bicycle for hours.

A fast-twitch or Type II muscle fiber can be understood as a muscle fiber that develops high tension rapidly. It is usually innervated by a single alpha neuron and has low fatigue resistance, low capillary density, low levels of aerobic enzymes, and low oxygen availability. Fast-twitch fibers are used in activities such as sprinting, jumping, and weight-lifting.

These distinctions seem to influence how muscles respond to training and physical activity, and each fiber type is unique in its ability to contract in a certain way. Human muscles contain a genetically determined mixture of both slow and fast fiber types. On average, humans have about 50 percent slow-twitch and 50 percent fast-twitch fibers in most of the muscles used for movement.

A human's muscle fiber type may influence what sports they naturally excel at or whether one is fast or strong. Olympic athletes tend to fall into sports that match their genetic makeup. Olympic sprinters have been shown to possess about 80% fast-twitch fibers, while those who excel in marathons tend to have 80% slow-twitch fibers.

As to be described hereafter, the example system 300 and associated exercise protocols therewith is designed specifically to activate and strengthen Type II muscle groups and its surrounding fasciae while simultaneously inhibiting and releasing Type I muscle groups and its surrounding fasciae. As research, literature and muscle biopsy reveals, skeletal muscles, i.e., the muscles that move joints, can be divided into two distinct categories. Each category can be referred to correctly with any of the following terms, relative to each other: (a) Type I—also described as tonic, postural, overactive, red muscle, slow-twitch. These have a tendency to be short relative to its Type II counterpart; these Type I muscles may be considered "Mechanically Advantaged"; and (b) Type II—also described as phasic, powerful mover, under active, white muscle, fast-twitch. These have a tendency to be long relative to its Type 1 counterpart; these Type II muscles may be considered "Mechanically Disadvantaged".

As to be described hereafter, the example system 300 and associated exercise protocols therewith is designed to activate and strengthen Type II muscles, or under active and mechanically disadvantaged muscles, and their surrounding fasciae, while simultaneously inhibiting and releasing Type I muscles, or overactive and mechanically advantaged muscles, and their surrounding fasciae. Type I muscles are mechanically advantaged over their counterpart Type II muscles, e.g., hip flexor muscles are highly mechanically advantaged over hip extensors. The same is true of shoulder flexors and shoulder extensors. Unless specific action is taken to activate and strengthen mechanically disadvantaged muscles, such as hip extensors, hip internal rotators, shoulder extensors, shoulder external rotators, shoulder depressors, ankle internal rotators, ankle flexors, trunk rotators, etc., joints will be controlled predominately by the mechanically advantaged Type I muscles and joints will lose motion in all other axes except those controlled by the mechanically advantaged muscles.

As example, the muscles that move the shoulder include pectoralis major (shoulder protractor), which is mechanically advantaged over the rhomboids (shoulder retractors); upper trapezius and elevator scapulae (shoulder elevators), which are mechanically advantaged over serratus anterior, pectoralis minor and lower trapezius (shoulder depressors); and latissimus dorsi, subscapularis, teres major (shoulder internal rotators), which are mechanically advantaged over the infraspinatus and teres minor (shoulder external rotators).

If allowed to follow a natural progression set up by anatomical makeup and lifestyle, the shoulders will develop a forward, upward and inward rotated position. This position is a fertile environment for strain and injury to the muscles around the shoulder and the shoulder joint itself. This poor position is also the major contributor to a forward head position and issues of the neck and cervical spine. In the United States, this faulty shoulder position is pandemic.

As to shoulder girdle and shoulder joint muscles, a position on hands and knees allows the overactive Muscles (Type I) to completely relax while the under active muscles (Type II) are strongly activated and strengthened. Example Type II muscles in the shoulder girdle and joint that may be strongly activated and strengthened using system 300 and an associated external shoulder rotation exercise protocol include infraspinatus, teres minor, serratus anterior, lower trapezius, posterior deltoid, pectoralis minor and rhomboids. Example Type I muscles in the shoulder girdle and joint that may be inhibited and released using system 300 and an associated external shoulder rotation exercise protocol include pectoralis major, upper trapezius, elevator scapula, latissimus dorsi, subscapularis, teres major, and anterior deltoid. This exercise, to be described in more detail hereafter in accordance with use of system 300, has proved beneficial in returning the shoulder girdle and shoulder joint to a normal position and helpful in maintaining that position.

With regard to foot and ankle muscles, in a position on system 300, leaning against a flat wall, a squat exercise protocol enables the overactive Type I muscles to completely relax while the under active Type II muscles are strongly activated and strengthened. Example Type II muscles which may strongly activated and strengthened include tibialis anterior, tibialis posterior, peroneus longus, quadratus plantae. Example Type I muscles in the foot and ankle that may be inhibited and released using system 300 and an associated squat exercise protocol include the gastrocnemius and soleus, which serves to release the Achilles tendon. This exercise, to be described in more detail hereafter in accordance with use of system 300, has proven beneficial with balance, calf/ankle/foot injury reduction, Achilles injury reduction, and rehabilitation of all muscles and joints associated with the foot, ankle, calf and knee.

Turning now to the drawings, the example rotational resistance system 300, as shown by reference to FIGS. 4-7, is designed to be employed with the user standing on two devices 305 in adjacent relation on a floor or planar surface. In one configuration, this is done while leaning against a flat wall and/or with the hands and knees of the user stabilized on a floor. Use of the example system 300 while leaning on a flat wall or stabilized on a floor offers relaxation to the muscles that tend to be overused, and simultaneously provides strong activation to underused muscles. By using the system 300 as instructed, a muscle and fascial release is acquired; this may be elicited in about 1.5 minutes. In another configuration, system 300 may be employed by a user in a kneeling position when hands on each of the rotatable hand plates 330 on turntables 340.

Referring to FIG. 4-7, each device 305 of system 300 may include a base 310 having a hollow cylindrical central portion which houses a support structure 320 therein. A top surface 322 of the base 310 and upper portion of the support structure 320 are each at an angle of inclination relative to horizontal. A circular rotatable plate 330 (also referred to occasionally hereafter as a foot plate 330 or hand plate 300) is provided on top surface 322 of base 310, as shown.

Optionally, device 305 may be provided with a vibration attachment, not shown, to vibrate the rotatable plate 330 during exercise. In an example, the vibration attachment may be an electromagnetic vibration device attached to the plate 330, and configured at a given or variable vibration frequency. Vibration helps activate the muscles which are contracting to provide more action potentials during the time the muscles are being exercised.

Device 305 includes internal resistance means for providing resistance and release of resistance against rotation of the plate 330. The internal resistance means may be composed of a "Lazy Susan" turntable 340 connected to an underside of foot plate 330, and a door knob-type spring 326 providing tension via a spring actuator 321 and arranged within the support structure 320 for smoother movement and symmetrical tension from side to side. Thus, device 305 and current exercise protocols do not require and do not advocate the use of a front foot support as shown and described in the '747 patent. As noted, the spring 326 is actuated to impart tension (and hence resistance to rotation of foot plate 330) via the spring actuator 321. The turntable 340 is secured to the spring actuator 321 via a suitable fastening means (not shown) such as screws, rivets, etc., engaging tapped bores 327 in the spring actuator 321. As the turntable 340 rotates, it will turn the spring actuator 321 so as to engage spring 326, generating tension.

A pair of post supports 323 extends up from a post support base 328. The post supports 323 are continuous with post 325 to keep the post 325 from torquing in any other direction besides pure rotation. This prevents the post 325 from eventually breaking off due to over-torque.

Each example device 305 of system 300 may be manufactured with a pre-set 11° angle of inclination from horizontal for the top surface 322 of base 310 and that of the support structure 320. This puts certain muscles at a mechanical disadvantage, allowing their functionally opposite muscles to attain greater activation and an increased range of motion. Variable elevations for the top surface of base 310 and that of the support structure 320 from 6° to 26° are available to provide different levels of exercise; lower elevations provide a less difficult exercise and higher elevations are more strenuous.

Figure 7:
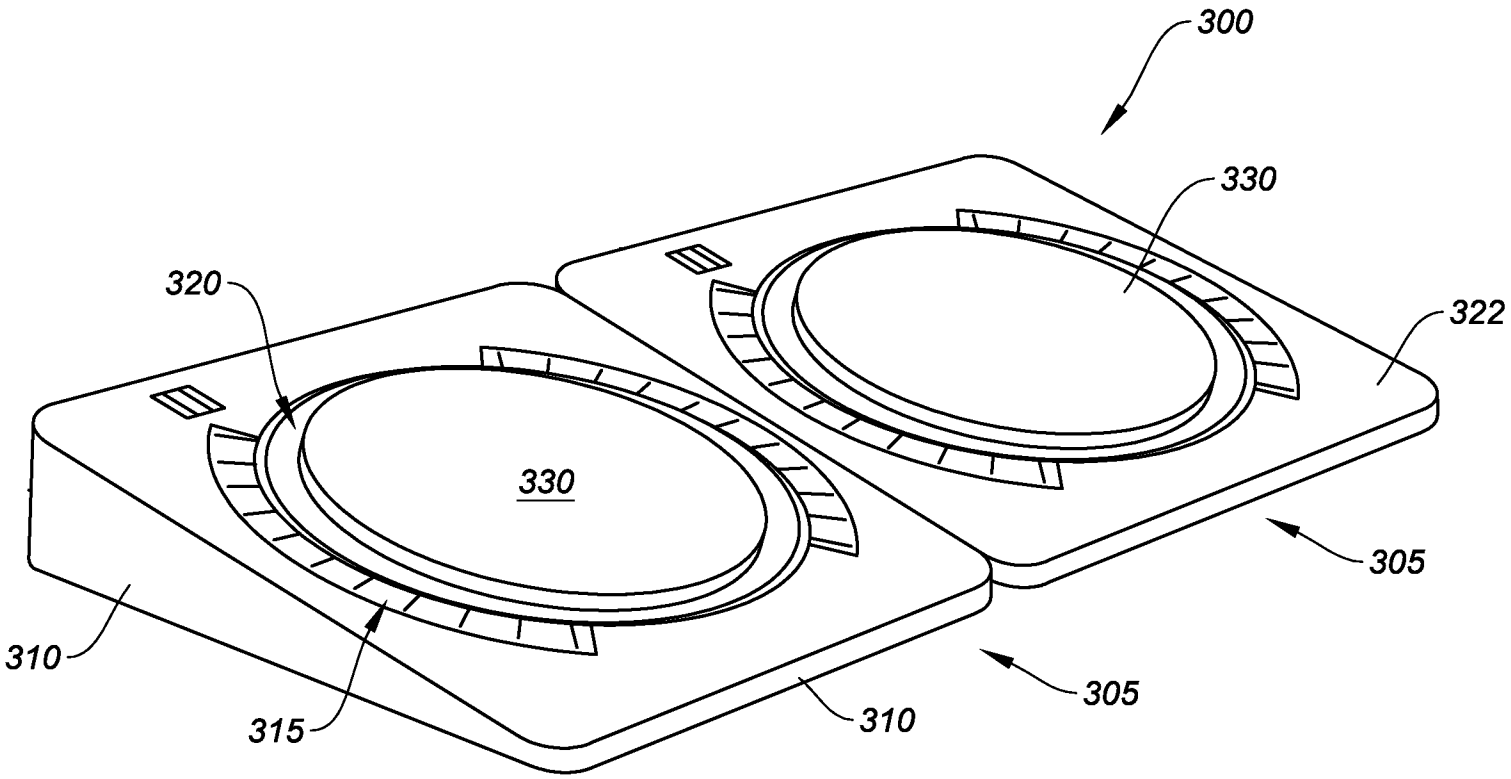
FIG. 7 illustrates a perspective view of the example rotational resistance system.

Through extensive testing, the inventor has discovered that elevation changes to the device 305 dramatically affect the difficulty level in order for a user to rotate the turntable 340. As the top surface 322 and rotatable plate 330 can be variably adjusted to elevations from 6° to 26°, testing has shown that angles of inclination greater than or equal to 20° is exponentially more difficult than an inclination set of 11°. Employing a simple wedge which is the exact same size as that of the base 310 would enable further addition or subtraction to this range of elevation. This is a much simpler and superior means in which to add or reduce tension. Also as shown in FIG. 7, the top surface 322 may include a degree of rotation indicator 315. Indicator 315 may include visual indicia illustrating a range of rotation between 0-50 degrees in either direction, both internal and external ranges.

In general, the housing of device 305, inclusive of base 310, support structure 320, rotatable plate 330, and turntable 340 may be formed by an injection molding process from a medium or heavy gauge impact plastic such as acrylonitrile butadiene styrene (ABS). ABS is an easily machined, tough, low-cost, rigid thermoplastic material with medium to high impact strength, and is a desirable material for turning, drilling, sawing, die-cutting, shearing, etc.

ABS is merely one example material; equivalent materials include various thermoplastic and thermoset materials that have characteristics similar to ABS. For example, polypropylene, high-strength polycarbonates such as GE Lexan, and/or blended plastics may be used instead of, or in addition with ABS. The materials comprising the devices 305 of system 300 (plastic such as ABS, rubber and lightweight metal materials) provide a light yet durable device 305. An exemplary injection molding system for forming molded plastic articles included in device 305 may be the Roboshot® injection machine from Milacron-Fanuc. The Roboshot is one of many known injection molding machines for forming plastic injection molds.

Proper use of system 300 enhances alignment, explosion and durability for the user. For example, system 300 may be particularly applicable to users who cannot body squat to a parallel position, by enabling them to achieve a full squat after just a few days of use of the system 300 with the suggested exercise protocols. This is significant, as the inability to perform a deep squat is generally a top injury predictor in many college and professional sports.

System 300 also is adapted to help a user dramatically increase their hip, ankle and shoulder ranges of motion. Specific muscles activated by the example system 300 for an internal hip rotation exercise may include but are not limited to the gluteus medius, tensor fascia lata, adductor magnus, semimembranosis, rectus abdominis, gluteus maximus, hamstrings, internal abdominal oblique, transverse abdominis, tibialis anterior, and tibialis posterior muscles. Specific muscles released by the example system 300 for internal hip rotation may include but are not limited to the piriformis, gemellus superior, gemellus inferior, obturator internus, obturator externus, quadratus femoris, external abdominal oblique, lower paraspinal muscles, and peroneus longus muscles.

Specific muscles activated by the example system 300 for a squat exercise may include but are not limited to the tibialis anterior, tibialis posterior, and peroneus longus muscles. Specific muscles and tendons released by the example system 300 for a squat exercise may include, but are not limited to the gastrocnemius and soleus muscles, and the Achilles tendon. Specific muscles activated by the example system 300 for an external shoulder rotation exercise may include but are not limited to the rhomboids, infraspinatus, teres minor, posterior deltoid, serratus anterior, lower trapezius, serratus posterior inferior, and pectoralis minor muscles. Specific muscles released for external shoulder rotation may include but are not limited to the latissimus dorsi, subscapularis, teres major, upper trapezius, serratus posterior superior, and pectoralis major muscles.

System 300 and its associated exercise protocols are specifically tailored to addressing factors related to pain and stiffness, including but not limited to muscle and fascial balance, flexibility and range of motion, back and hip pain, and shoulder and neck pain. There are all kinds of reasons for pain and stiffness, but muscle imbalance outranks all others combined. Every muscle and group of muscles in the body has an opposite muscle, or set of muscles. When one set of muscles, like the lower back muscles, are short and too tight, and the opposite set will be long and weak, like the abdominals. This is referred to as muscle imbalance. The same is true of the fasciae which covers all the muscles throughout the body.

One large problem muscle imbalance causes is that it creates a constant strain on the group of muscles that are long and weak, which causes both discomfort and inflexibility—when a muscle is too long, and it is stretched further, the body will tighten even more to keep it from tearing. If dramatic enough, short muscles on one side of a joint, such as the hip or the shoulder, will cause the joint to be very tight, will limit movement in that joint and, given enough time in that poor position, will cause the joint to deteriorate, needlessly.

System 300 and its associated exercise protocols help to restore muscle and fascial balance. Every exercise recommended to be performed on system 300 relaxes short muscles, while creating a strong contraction of the long and weak muscles, helping to correct imbalances of length and strength in muscles. Just one use on system 300 will begin to create more muscle and fascial balance. Using system 300 diligently will help to permanently balance muscles and fasciae and will help restore flexibility and mobility.

Good flexibility is simply being able to move through a complete range of motion in all directions. Lack of flexibility can be due to many things, but the top reason is muscle imbalance. A common misunderstanding about flexibility and range of motion is that they have only to do with the length of muscles. Actually, flexibility and range of motion are much more dependent on the length and strength ratios from one set of muscles to the other.

System 300 and its associated exercise protocols are built upon achieving the proper length and strength between muscles that tend to be short and overactive, in relation to their opposite muscles, which tend to be too long and underactive. When this is achieved, flexibility and range of motion improve immediately in about 85% of the population. Even in the other 15%, extra strength added to weak muscles will create more stability and balance in the body.

It is the inventor's position that strong glutes and balanced hips have more to do with a healthy back than any other factor. There are many different reasons for lower back and hip pain that cannot be addressed by system 300 and its protocols. However, system 300 does help correct muscle imbalance which, by far, is the number one cause of hip and lower back pain and stiffness.

In the majority of the population, lower back and hip pain and stiffness may be resolved by a diligent program of balancing the muscles around them. Especially in the active and athletic populations, most people are prone to have a forward tilted pelvis, which compresses the lower back and puts undue stress on the hips. Simply temporarily correcting that position brings immediate relief in most cases, and correcting it permanently usually completely resolves the problem.

System 300 and its associated exercise protocols are designed to correct problems of lower back and hip position. There are three main components of the problem and system 300 addresses all three, and helps correct them all at the same time, and in a very short time. Each exercise, while using system 300, takes less than a minute. This is accomplished by strengthening every long and under active muscle in and around the hips and lower back, and by relaxing each short and overactive muscle, all at the same time. This creates a more stable and relaxed body position.

It is the inventor's position that strong, balanced shoulders have more to do with a healthy neck than any other factor. Most of the muscles that support the neck originate from the shoulders. Balancing the shoulder muscles in all three planes, from front to back, side to side, and in rotation, offers more permanent relief for the neck than any other factor, technique, exercise or modality. Most active people carry their shoulders in a poor position. Because of our lifestyle and work patterns, we tend to carry our shoulders upward, forward, and rotated inward. These positions not only put stress on the shoulder itself, they also put undue stress on the neck because the position of the neck is a mirror of the position of the shoulders.

The shoulder program implemented with system 300 works to correct these positions, relieving tension on the shoulder and the neck. This is accomplished by balancing the muscles of the shoulders—strengthening the groups of muscles that are long and under active, and relaxing the ones that are short and overactive.

The example system 300 may be employed in the following activities: warm-up/activation before and recovery after exercise, rehabilitation from injury, functional training, and performance. For warm-up, moving freely, without restriction, in any sport, exercise or activity is a joy. Movement through a complete range of motion in all planes of motion is essential to superior performance. System 300 and its associated exercise protocols specifically strengthen many muscles which tend to be long and weak, and simultaneously relax those muscles that are too short, in the overwhelming amount of athletes. Research articles, such as one by Matthew F. Kritz, et al. entitled Static Posture Assessment Screen of Athletes: Benefits and Considerations—Strength and Conditioning Journal October 2008—Volume 30—Issue 5—pp. 18-27, state that about 85% of athletes have the same muscle imbalance issues. System 300 has been designed to correct these specific muscle imbalances. This immediately increases flexibility and range of motion, allowing the body to move more freely and dynamically, and with a reduced chance of injury.

For recovery, the key to consistent, sustained performance is getting the body back into the same position as it was before the activity, every time, after strenuous exercise. If not, two things will suffer—the body and performance. While it is important to replenish the body with the proper nutrition and fluids for recovery after sport and exercise, it is actually as important to return it back to its best structural position—a neutral position. This allows the body to relax, by reducing inflammation caused by exercise and taking needless stress off muscles and joints.

If a recovery program takes too long, the chances are a person will not do it consistently. Using system 300 in accordance with its associated exercise protocols takes approximately one and a half (1.5) minutes to balance most major muscles used in sports and exercise, immediately bringing it to a more neutral position.

Rehabilitation is the job of a specialist, such as a physical therapist, athletic trainer, chiropractor, or neuromuscular therapist. It implies an injury that needs serious and professional attention. System 300 is believed to be an excellent tool in a professional's clinic for a host of athletic type injuries. Used with the professional's own protocols, system 300 may be beneficial in rehabilitating and further preventing the following injuries: sports hernia, low ankle, high ankle, ACL, knee, patella-femoral tendonitis, hamstring, hip, lower back, shoulder, elbow, wrist, and spine.

Injury prevention is an in-exact science and is dependent on many factors. No matter how much effort is put into preventing injury, high force/high speed impact, as in football or a car accident, will cause damage to the body. System 300 and its associated exercise protocols are designed to prevent needless injury to the body. Used within a solid training program, it has proved to be beneficial in preventing the following injuries: Sports Hernias, ankle, knee, hamstring, hip, lower back, shoulder, and elbow. System 300 further is unique in that it takes so little time to use; thus people actually may use it daily. This helps to keep the body in a consistently neutral position—the optimal position to resist and prevent injury.

The example system 300 may be intended for use by an individual or family to insert into their existing fitness program, and may prove to be a valuable asset for active individuals, novice and elite athletes, healthcare professionals, athletic coaches and trainers, and mobile service personnel (such as military, fire, and police). The example system 300 may be particularly suitable for use by college athletic teams and athletes in their weight rooms and on travel by select teams within their systems.

As an example, football, basketball, soccer, and volleyball are sports that demand many different kinds of movement; hence these sports require strength in all the muscles of the body, not only the ones that produce force. When the same muscles are used over and over to produce the same movement pattern, such as sprinting, jumping, blocking, tackling, cutting, kicking, etc, those muscles will become stronger and shorter than other important muscles. This creates a muscle imbalance that leads to strain, stiffness, pain, and eventual injury.

System 300 and its associated exercise protocols are specifically designed to relax these force producing muscles while simultaneously demanding a strong contraction from their opposite muscles—the ones that reduce force (in other words, to help stop the action rather than to create it). When used for warm-up and recovery, system 300 and its associated exercise protocols immediately returns the body back to a more neutral position, making it more "opened up" and "ready for action". This neutral position is also the best for consistent performance, reducing needless inflammation, and greatly cutting down on the incidence of several sport related injuries—sports hernia, ankle, calf/Achilles, knee, hamstrings, hip, oblique, groin, lower back, shoulder, and elbow.

As another example, predominantly rotational sports like golf, baseball, tennis, and any other swinging or throwing sports have special considerations. Unlike other sports where the rotational muscles are merely stabilizers, now the rotators become the ones that actually create the movement, so they must be strengthened and trained to do so.

System 300 and its associated exercise protocols effectively strengthen the muscles that generate the power, create the speed, and as importantly, stop the rotational speed before it damages the joints, even in the most gifted athletes. Used for warm-up, system 300 brings the body to a more neutral position which promotes consistent performance, and provides more available range of motion (useable flexibility). When used directly after sport or exercise, the body returns to a position which reduces inflammation and promotes faster healing—this is called recovery. Also, a body free of stiffness and pain is much less likely to be injured, one of the biggest advantages of system 300 for reducing the incidence of lower back, ankle, calf/Achilles, knee, hamstring, groin, oblique, shoulder, elbow, and sports hernia/lower abdominal Injury.

As a further example, sports such as track, swimming, and cycling are basically straight ahead actions, except for flip turns in swimming (which most resemble the action of a gymnast or diver, as discussed in more detail below), and all have a basic "stroke"—either a stride in track, a stroke in swimming or a revolution in cycling. Since the body is going straight forward, the rotational muscles act primarily as stabilizers, but also to create a quick stop to the rotation of the hips and trunk to keep the body from wasting energy by allowing it to turn needlessly.

System 300 does provide the muscles which stabilize movement with ample strength to keep the body moving directly forward. However, the exercises performed on system 300 also create more range of motion for the ankles, hips, spine and shoulders, which help athletes to generate a more fluid stride, stroke or revolution.

Sports like gymnastics, diving, high jump, pole vault, discus, shot put, hammer throw, etc, require combined power of jumping and thrusting, and speed of full body rotation. System 300 and its associated exercise protocols address all those requirements for these athletes. While there are other individual exercises that may help to develop more power, thrust and speed, system 300 targets them all at once in a few exercises that take literally one minute each for warm-up and recovery, and which help prevent injury to the most often injured areas of the body in these sports. Inherent to the fundamental exercise on system 300, it dramatically reduces oblique, groin, hamstrings, ankle, lower back and shoulder injuries, as well as sports hernia.

Figure 9:
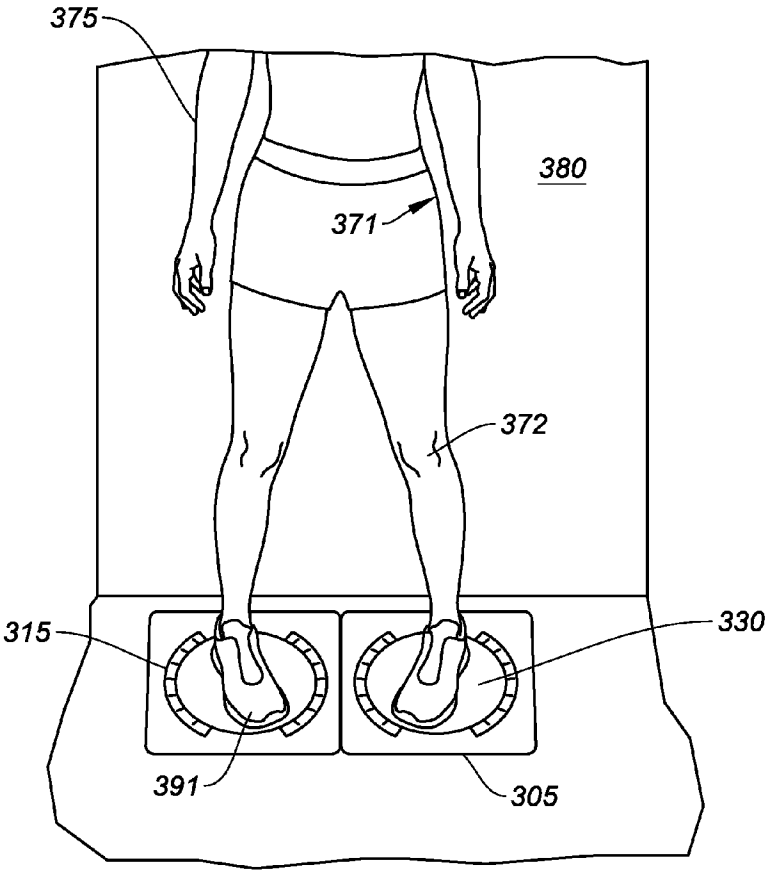
FIG. 9 is a perspective view of an inward hip rotation exercise protocol with the example rotational resistance system in accordance with the example embodiment.
Figure 8:
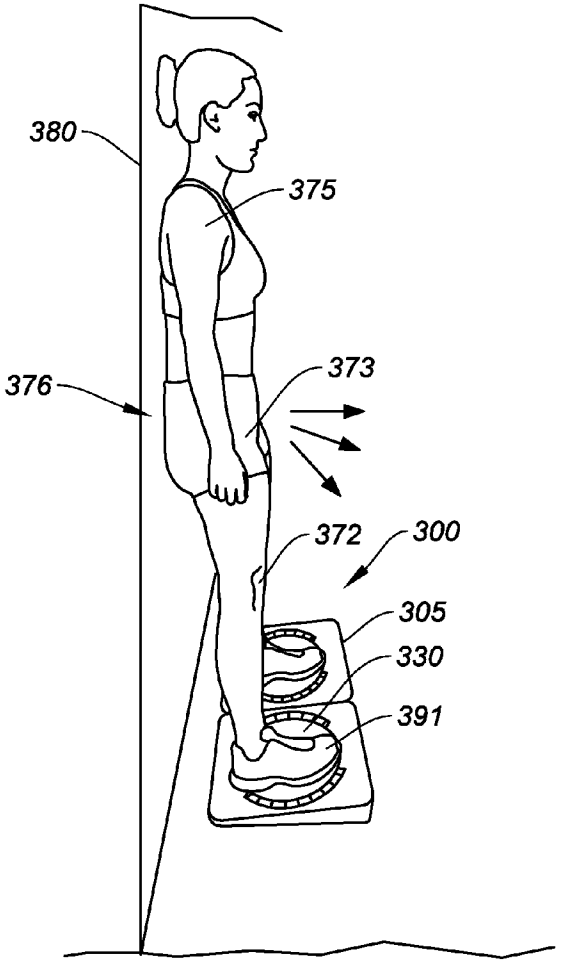
FIG. 8 is a perspective view of a pelvic tilt exercise protocol with the example rotational resistance system in accordance with the example embodiment.

FIGS. 8 and 9 are corresponding side and front views of a pelvic tilt exercise protocol (FIG. 8), performed alone or in conjunction with an inward hip rotation protocol of FIG. 9, using the example rotational resistance system 300. To prepare for this protocol, a user 375 places their feet a foot-width distance from a vertical surface such as wall 380 and places the devices 305 in side-by-side relation, spaced from wall 380. Their back contacts the wall 380, and to mount system 300, the user 375 places one foot on a corresponding device 305 between the two turntables 340, then moves the feet 391 laterally so each foot is centered on a foot plate 330 of a respective turntable 340.

As one example exercise protocol for the pelvic tilt, the user 375 will move their tailbone/pelvic area 373 down and forward (see top arrow of FIG. 8) while maintaining their back and particularly the lower back arch (shown by element 376), pressed flat on wall 380. With their feet 391, they will rotate each plate 330 inward a first angle against resistance (such as is shown in FIG. 9), hold for 10 seconds, then return feet 391 forward. Next, they will attempt to lower their tailbone/pelvic area 373 even further down (see middle arrow in FIG. 8, only using the muscles above the knees 372), repeat the inward rotation to a second angle from forward that is greater than the first, hold for 10 seconds, then return their feet 391 forward on the plates 330. The previous movements are repeated a third time, with tailbone/pelvic area 373 lowered even further (lowest arrow) and inward rotation to a third angle from forward greater than the second, hold for 10 seconds, then rest. The user 375 then dismounts from the devices 305 of system 300 and walks around in a rest period. Optionally, vibration of the foot plates 330 during the above exercise protocol may be added so as to activate the muscles which are contracting, thereby providing more action potentials during the time the muscles are being exercised.

Referring to FIG. 9, for the inward hip rotation exercise protocol and similar to the above, the user 375 stabilizes themselves on the wall 380 with feet 391 centered on the foot plates 330 of turntables 340. This creates a posterior pelvic tilt, placing the maximum muscles in and around the hips, pelvis and spine in a position so as to be activated or released. Holding the posterior pelvic tilt throughout, the user 375 turns inward with their hips 371 instead of their feet 391. This inward hip rotation in turn forces the feet 391 to rotate inward, thereby rotating the foot plates 330 on turntables 340. The hips 371 are turned inward to maximum amount, three consecutive times, each time holding at maximum rotation for 10 seconds. Optionally, vibration of the foot plates 330 during the above exercise protocol may be added so as to activate the muscles which are contracting, thereby providing more action potentials during the time the muscles are being exercised. A summary of the inward hip rotation protocol is provided in Table 1 below.

TABLE 1

INWARD HIP ROTATION PROTOCOL

| STEP | COMMENT(s) |
|---|---|
| 1. Place devices 305 side by side, foot's width from wall 380 | |
| 2. Tuck pelvis 373 under | Tilting pelvic area/tailbone down and forward. |
| 3. Slowly rotate hips 371 inward | Plates 330 rotate on turntables 340, causing feet 391 to rotate inward from center |
| 4. Hold 10 seconds, do not release tension | Knees 372 remain still |
| 5. Turn hips 371 inward more | Feet 391 rotate slightly inward from previous point. |
| 6. Hold 10 seconds, do not release tension | Knees 372 remain still |
| 7. Turn hips 371 inward more | Feet 391 rotate slightly inward from Step 5 point. |
| 8. Hold 10 seconds, do not release tension | Knees 372 remain still |
| 9. Step off devices 305 and walk around | Allows user 375 to feel results of exercise |

The pelvic tilt exercise protocol is designed and has been shown, using vaginal sensor probe EMG, to strongly activate the Type II muscles of the pelvic floor, while inhibiting and relaxing their surrounding opposite Type I muscles. The pelvic floor muscles are responsible for control of bladder and assist in urinary and fecal continence, aid in sexual orgasm, stabilize connecting joints and act as a venous and lymphatic pump for the pelvis. Of note, the sacrum, the base of the pelvis, is the skeletal anchor of the thoracolumbar fascia which is the largest and most centralized part of the fascial system of the body and also the entire connective tissue system.

The pelvic floor Type II muscles strongly activated by the exercise performed on system 300 as described with regard to FIG. 8 include the elevator ani—pubococcygeus (pubovaginalis, puborectalis), iliococcygeus; and coccygeus (ischiococcygeus); the Type I pelvic floor muscles inhibited and released include the piriformis, and obturator internus. By putting the postural muscles surrounding the pelvis at rest due to the user 375 leaning against wall 380, the pelvic floor is easily and strongly activated and strengthened, against a strong resistance, using system 300 implemented the exercise protocol described above.

Case Example

Incontinence and Pelvic Floor Activation

In a controlled environment at Woman's Hospital in Baton Rouge, La., a pilot study was conducted on three healthy nurses who teach and perform pelvic floor activation and incontinence reduction measures, including Kegel exercises, to patients on a daily basis. Subjects were evaluated pre- and post-study using a vaginal sensor and the Pathway MR-20 biofeedback unit. It is important to note that these initial results were obtained from a small population of healthy nurses who have been teaching pelvic floor exercises and performing them daily for many years. Therefore, it was agreed beforehand that any gain in pelvic floor activation among these nurses would be considered significant.

The results from the three-week pilot study revealed:

a) Pelvic floor activation improvement using Kegel exercises alone: Subject 1—27.5%, Subject 2—34%, Subject 3—23%;
b) Average Kegel-based pelvic floor activation improvement—28%;
c) Pelvic floor activation improvement using system 300 implementing pelvic tilt protocol/no Kegel exercises performed: Subject 1—113%, Subject 2—38%, Subject 3—100%; and
d) Average pelvic floor activation improvement using system 300—83%.

Case Example

Inward Hip Rotation Protocol

To make significant gains in restoring muscle and fascial balance, it is imperative that the overactive Type I muscles be forced to relax, while the under active Type II muscles be strongly activated and strengthened. Electromyography (EMG) is a diagnostic procedure to assess the health of muscles and the nerve cells that control them (motor neurons). Motor neurons transmit electrical signals that cause muscles to contract. A formal EMG study and controlled range of motion studies have shown that by "unloading" or "relaxing" the body on a flat wall or floor while performing exercises (such as inward hip rotations), the overactive muscles are allowed to relax. This creates a much greater ratio of activation to relaxation between under active to overactive muscle types, respectively.

Use of system 300 with the inward hip rotation exercise protocol has consistently yielded great gains in joint ranges of motion, instantaneously, which increases measurably over time. For example, in a controlled eight (8) week study performed at Louisiana Tech University, it was proven that college golfers increased total hip rotation on an average of 40.8 degrees, using no other exercise, modality, or stretching method than the inward hip rotation protocol on the devices 305 of system 300.

Figure 10:
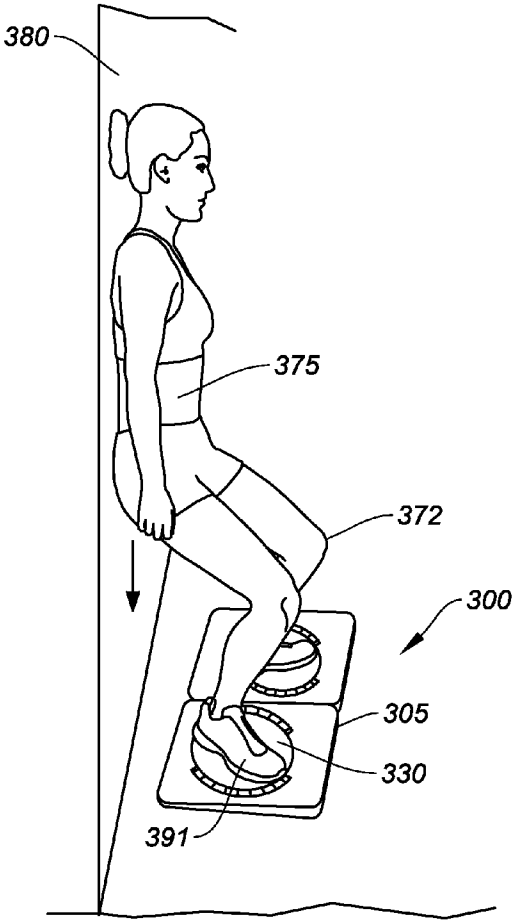
FIG. 10 is a perspective view of a squat exercise protocol with the example rotational resistance system in accordance with the example embodiment.

FIG. 10 is a perspective view of a squat exercise protocol using the example rotational resistance system 300 in accordance with the example embodiment. To prepare for this protocol, the user 375 orients themselves exactly as they did for the pelvic tilt/inward hip rotation protocols: feet 391 a foot-width distance from wall 380, back against the wall 380, and centering each foot on a foot plate 330 of a respective turntable 340.

In one example exercise protocol for the squat, the user 375 pushes each heel down onto the back/lower part of a corresponding foot plate 330 as hard as they can do so; toes up. They will then slowly inch down the wall 380 (a squat) until they feel a stretch in the back of their calves and Achilles, then stop. With their knees pointing straight forward, the user 375 then rotates the toes of each foot inward toward each other, pushes the heels down even harder, and holds the squat position for 10 seconds (such as is shown in FIG. 10), thereafter returning feet forward on foot plates 330 and maintaining the squat position. The user 375 then squats further down the wall 330, and thereafter pushes their heels downward forcefully. This is repeated, but the user 375 squats even a bit deeper down the wall 380, stops, presses heels hard down, and rotates feet inward (or outward) and holds for 10 seconds. Thereafter, the user 375 returns their feet forward on foot plates 330 and rises back up on wall 380.

This is repeated a third time, down at a deeper squat and opposite foot rotation, held for 10 seconds. During the entire 30 second exercise, the user 375 never returns to the starting position, so as to maintain the squat gain they have achieved. The user 375 then returns feet 391 forward, lifts up, dismounts the devices 305, and walks around in a rest period to feel the effects of the squat exercise. Optionally, vibration of the foot plates 330 during the above exercise protocol may be added so as to activate the muscles which are contracting, thereby providing more action potentials during the time the muscles are being exercised. A summary of the squat protocol is provided in Table 2 below.

TABLE 2

SQUAT PROTOCOL

| STEP | COMMENT(s) |
|---|---|
| 1. Place devices 305 side by side, foot's width from wall 380 | Mount machine properly |
| 2. Push heels forcefully down on lower part of each plate 330 | |
| 3. Begin sliding down wall 380 until slight stretch in calves felt | Knees still over center of plates 330; heels remain forced down |
| 4. Slowly rotate ankles inward on plates 330 | Bring toes toward each other, hips 371 and knees 372 remain still. |
| 5. Hold 10 seconds, do not release tension | Knees 372 and hips 371 remain still. |
| 6. Bring ankles back to neutral | Knees 372 and hips 371 remain still. |
| 7. Squat deeper along wall 380 | Knees 372 and hips 371 remain still. |
| 8. Hold 10 seconds, do not release tension | Knees 372 and hips 371 remain still. |
| 9. Slowly rotate ankles inward on plates 330 | Knees 372 and hips 371 remain still. |
| 10. Hold 10 seconds, do not release tension | Knees 372 and hips 371 remain still. |
| 11. Return to start position and step off devices 305; walk around | Allows user 375 to feel results of exercise |

Figure 11:
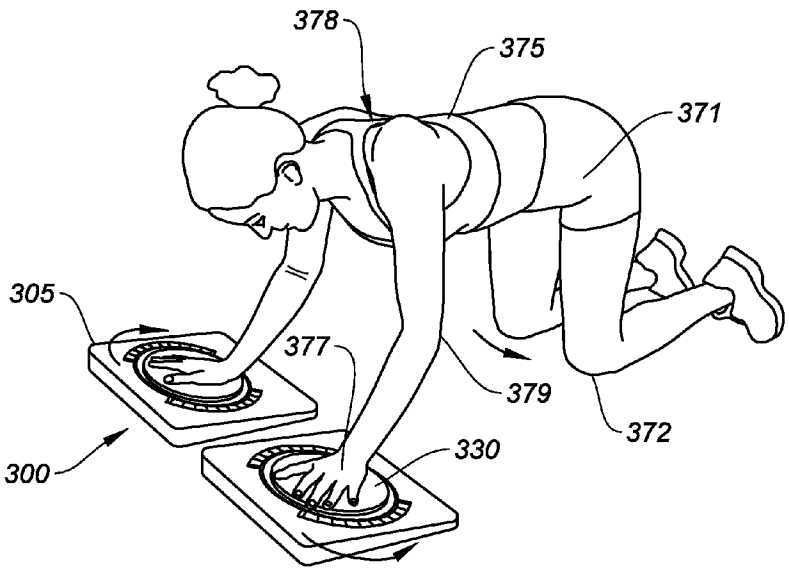
FIG. 11 is a perspective view of a shoulder rotation exercise protocol with the example rotational resistance system in accordance with the example embodiment.

FIG. 11 is a perspective view of an outward shoulder rotation exercise protocol using the example rotational resistance system 300 in accordance with the example embodiment. To prepare for this protocol, the user 375 positions their hands 377 slightly wider than shoulder-width apart, places each hand 377 on the center of a corresponding hand plate 330, places knees 372 on the ground so they are directly under the hips 371 of the user 375. For this example exercise protocol, the user 375 locks out their elbows 379 initially, and slowly bring their chest to the floor (see arrow), so that it appears as if their spine 378 is curved in a concave plane, as shown in FIG. 11. In this position, they will rotate each shoulder in to an outward position on a corresponding hand plate 330 approximately 30° outward from forward, which forces the elbows 379 down toward the knees 372, and hold for 10 seconds. This exercise is repeated twice more at 10 second intervals, but with shoulders rotating outward on foot plates 330 approximately 40° for repetition 2, and 50° for repetition three. Similar to the squat protocol, the user 375 never returns their hands 377/shoulders back to the neutral or starting position until the entire exercise has been completed. The user 375 then dismounts the devices 305 and walks around in a rest period. A summary of the outward shoulder rotation protocol is provided in Table 3 below.

TABLE 3

| OUTWARD SHOULDER ROTATION PROTOCOL | |
|---|---|
| STEP | COMMENT(s) |
| 1. Place devices 305 side by side in open area, spaced from each other | Mount machine properly; center of rotation of each hand plate 330 about 2 inches wider on each side than shoulder width. |
| 2. Kneeling position with hands 377 on center of plates 330. | Top of shoulder aligned vertically over lower end of device 305; knees 372 position directly under hips 371. |
| 3. Elbows 379 straight, drop chest toward floor | Shoulder blades come together, spine 378 drops through shoulder blades; lower back arch 376 remains flat. |
| 4. Pull shoulder blades down and in | Causes elbows 379 to bend down toward knees 372. |
| 5. Slowly rotate shoulders outward so hands 377 rotate outward 30 degrees from center | |
| 6. Hold 10 seconds, do not release tension | Knees 372 and hips 371 remain still. Elbows 379 bent. |
| 7. Pull shoulder blades down and in | Further than in Step 4. Causes elbows 379 to bend down toward knees 372. |
| 8. Slowly rotate shoulders further outward so hands 377 rotate outward 40 degrees from center | |
| 9. Hold 10 seconds, do not release tension | Knees 372 and hips 371 remain still. Elbows 379 bent. |
| 10. Pull shoulder blades down and in | Further than in Step 7. Causes elbows 379 to bend further down toward knees 372. |
| 11. Slowly rotate shoulders further outward so hands 377 rotate outward 50 degrees from center | |
| 12. Hold 10 seconds, do not release tension | Knees 372 and hips 371 remain still. Elbows 379 bent. |
| 13. Return to start position, get up and walk around | Allows user 375 to feel results of exercise |

Figure 12:
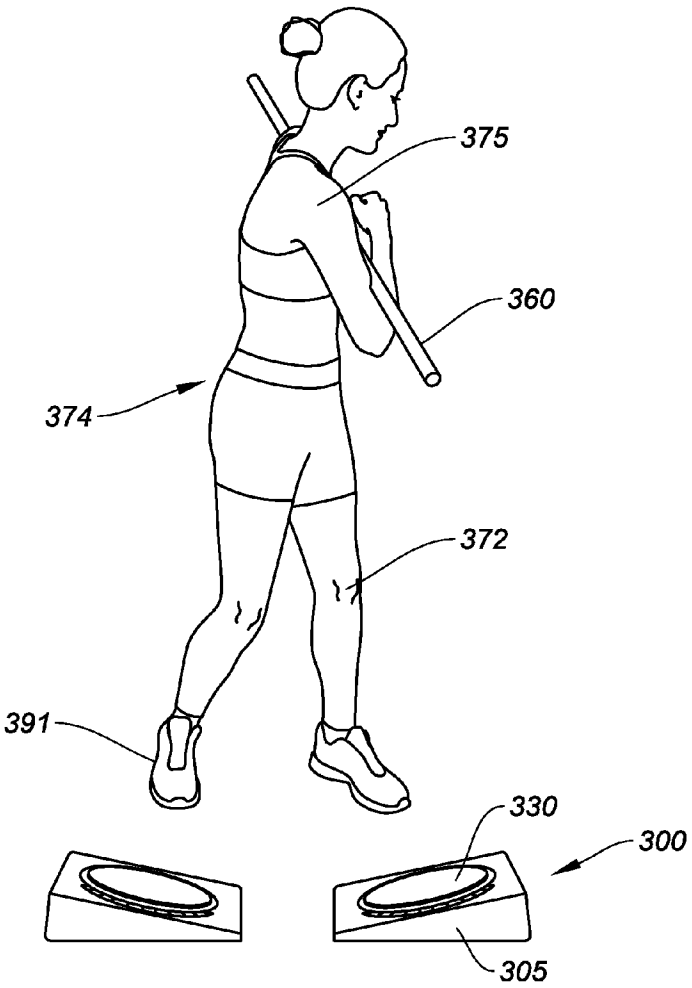
FIG. 12 is a side view of the devices of the system with a user performing a pre-exercise evolution to increase range of motion.
Figure 14:
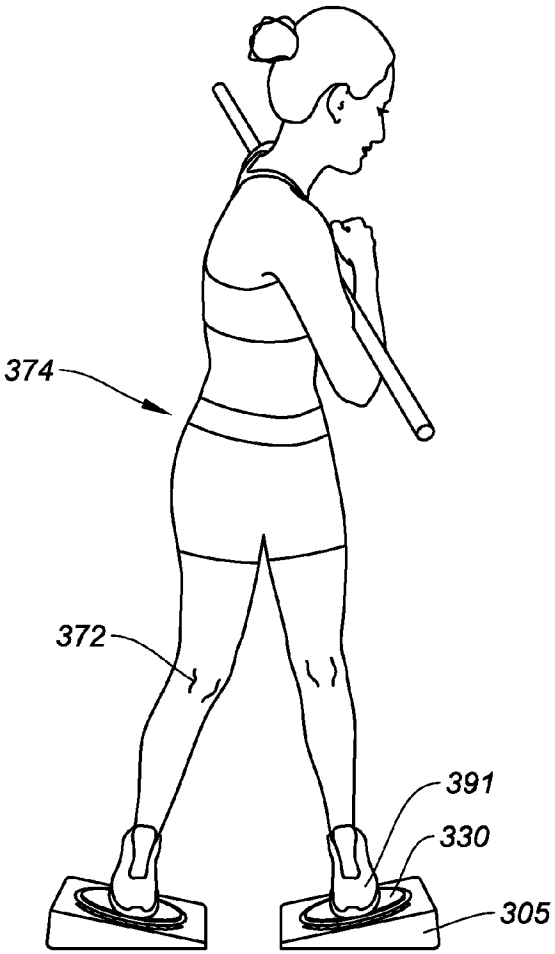
FIG. 14 is a side view of the devices of the system with the user thereon implementing a maximal left trunk turn as part of a range of motion exercise protocol.
Figure 13:
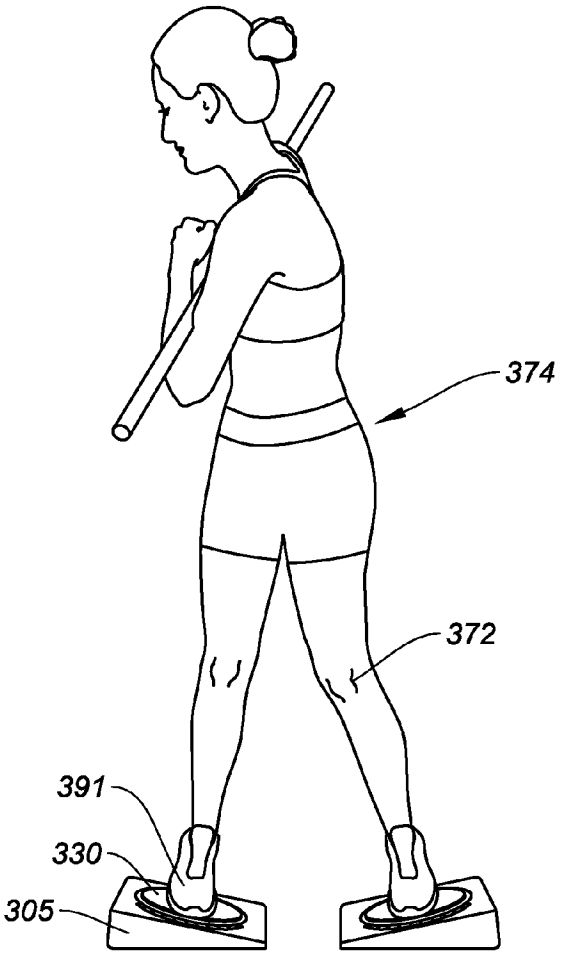
FIG. 13 is a side view of the devices of the system with the user thereon implementing a maximal right trunk turn as part of a range of motion exercise protocol.

FIGS. 12-14 illustrate a user on system 300 implementing an exercise to increase rotational range of motion of the user. Referring to FIGS. 12-14, and unlike previous exercise protocols, here the devices 305 are placed in an open area in facing relation, with the lower ends of the slanted surfaces 322 facing each other. Additionally, and unlike the previous protocols, the user 375 holds an elongate member in crossed arms across their chest, such as dowel 360. Table 4 below provides a summary of this range of motion exercise protocol.

TABLE 4

| RANGE OF MOTION PROTOCOL | |
|---|---|
| STEP | COMMENT(s) |
| 1. Place devices 305 in facing relation to each other | About length of a foot apart, or so centers of the plates 330 are shoulder width |
| 2. Prior to mounting, hold dowel 360 in crossed arms across body (start position), rotate trunk 374 to max left and right directions | See FIG. 12, provides reference point for later comparison |
| 3. Mount devices 305, feet 391 in centers of plates 330, knees 372 slightly bent, upper body bent slightly forward at trunk 374 | See FIGS. 13 and 14 for mounting |
| 4. Look down to right foot, rotate trunk 374 to max right rotation so dowel 360 pointed substantially perpendicular to start position | See FIG. 13 |
| 5. While looking down, turn right foot inward, hold for 5 seconds, then relax. | See FIG. 13, trunk 374 remains still |

TABLE 4-continued

| RANGE OF MOTION PROTOCOL | |
|---|---|
| STEP | COMMENT(s) |
| 6. Repeat step 5 four (4) more times, increase inward turn of right foot each time. | Trunk 374 remains still. |
| 7. Return to center forward, relax | Knees 372 remain slightly bent, user 375 bent slightly forward at trunk 374. |
| 8. Look down to left foot, rotate trunk 374 to max left rotation so dowel 360 pointed substantially perpendicular to start position | See FIG. 14 |
| 9. While looking down, turn left foot inward, hold for 5 seconds, then relax. | See FIG. 14, trunk 374 remains still |
| 10. Repeat step 9 four (4) more times, increase inward turn of left foot each time. | Trunk 374 remains still. |
| 11. Return to center forward, step off devices 305 and walk around | Allows user 375 to feel results of exercise |
| 12. Re-check range of motion with dowel 360 as compared to reference point at start position | |

Accordingly, in the range of motion protocol, the trunk 374 is rotated maximally and held statically, the hips 371 are turned inward maximally and held for 5 seconds, and then the hips 371 are permitted to turn back to a neutral position but the trunk 374 is held in its position of rotation, and then the trunk 374 is rotated further in the same direction, gaining even more rotation. This routine is repeated until the trunk 374 cannot gain any more rotation.

Initial testing has shown an individual may increase rotational trunk and hip range of motion by as much as 50° immediately with this exercise, and increase as much as 30 degrees permanently within three weeks, using only this exercise. The immediate effects are beneficial for warm-up/activation before exercise, injury prevention and recovery/reactivation after exercise. The permanent gains are beneficial for all activities of daily living, as well as sport and exercise.

Case Example

Post Activation Potentiation

This is a relatively new term in sport and all aspects of it are not well understood, such as, which systems of the body produce the effect. The premise is that if certain muscles are stressed to the greatest degree, there is a short term benefit (from about 5-30 minutes in duration post-exercise) in dynamic and explosive capacity. An example is one that was used in the most recent 2015 NFL Combine in Indianapolis, Ind. in an effort to increase vertical jump and 40-yard dash scores. The athletes performed a deep squat with heavy weights, just prior to testing, and doing so did improve their scores.

The range of motion exercise protocol described above, under post-isometric relaxation exercises, has been tested with the reigning 2014 Golf Long Drive World Champion and a former kicker for the New Orleans Saints football team, to determine if it provides Post Activation Potentiation. In both cases, swing speed and leg speed were increased to a capacity to allow for about 8 mph greater swing speed in the long driver and, repeatedly, an extra 10 yards of field goal distance in the NFL kicker.

Accordingly, the example system 300 may provide several benefits. For example, the support structure 320 is adapted to bring major joints to a neutral position; use of the devices 305 of system 300 act to relieve most mechanical-type hip and back pain, and increases power of the core. Additionally, use of the system 300 relaxes overactive muscles, increases hip motion, and improves action of the hips and pelvis. Further, use of the system 300 may increase stability of the ankles, knees, hips, spine, and shoulders, provides pre-exercise activation of all rotational muscles in the entire body, and offers recovery from exercise. Moreover, use of the system 300 may increase strength and stability of the shoulder and of all the small muscles around the spine.

The example embodiments having been described, it is apparent that such have many varied applications. For example, the example embodiments may be applicable but not limited to connection to various devices, structures and articles.

The present invention, in its various embodiments, configurations, and aspects, includes components, systems and/or apparatuses substantially as depicted and described herein, including various embodiments, sub-combinations, and subsets thereof. Those of skill in the art will understand how to make and use the present invention after understanding the present disclosure. The present invention, in its various embodiments, configurations, and aspects, includes providing devices in the absence of items not depicted and/or described herein or in various embodiments, configurations, or aspects hereof, including in the absence of such items as may have been used in previous devices, e.g., for improving performance, achieving ease and\or reducing cost of implementation.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments, configurations, or aspects for the purpose of streamlining the disclosure. The features of the embodiments, configurations, or aspects of the invention may be combined in alternate embodiments, configurations, or aspects other than those discussed above. This method of disclosure is not to be interpreted as reflecting an intention that the claimed invention requires more features than are expressly recited in each claim. Rather, as the following claims reflect, inventive aspects lie in less than all features of a single foregoing disclosed embodiment, configuration, or aspect. Thus, the following claims are hereby incorporated into this Detailed Description, with each claim standing on its own as a separate preferred embodiment of the invention.

Moreover, though the description of the invention has included description of one or more embodiments, configurations, or aspects and certain variations and modifications, other variations, combinations, and modifications are within the scope of the invention, e.g., as may be within the skill and knowledge of those in the art, after understanding the present disclosure. It is intended to obtain rights which include alternative embodiments, configurations, or aspects to the extent permitted, including alternate, interchangeable and/or equivalent structures to those claimed, whether or not such alternate, interchangeable and/or equivalent structures disclosed herein, and without intending to publicly dedicate any patentable subject matter.

I claim:

1. A rotational resistance system, comprising:

a pair of separate rotational resistance devices arranged in side-by-side relation on a ground surface next to a wall, each device further including a rotatable foot plate thereon and internal resistance means therein for providing resistance and release of resistance against rotation of the plate, each plate adapted so that a user, with a corresponding foot on each device and their back being supported by the wall, performs a hip rotation exercise to activate selected under active muscles and release selected overactive muscles.

2. The system of claim 1, wherein a combination of exercise thereon with the user's body in a supported, unloaded position on the devices inherently effects myofascial balance between the under active and overactive muscles.

3. The system of claim 1, wherein muscles activated through the hip rotation exercise include at least one or more of the gluteus medius, tensor fascia lata, adductor magnus, semimembranosis, rectus abdominis, gluteus maximus, hamstrings, internal abdominal oblique, transverse abdominis, tibialis anterior, and tibialis posterior muscles, and muscles released include at least one or more of the piriformis, gemellus superior, gemellus inferior, obturator internus, obturator externus, quadratus femoris, external abdominal oblique, lower paraspinal muscles, and peroneus longus muscles.

4. The system of claim 1, each device further including a support structure on the ground surface, the foot plate serving as the top surface of the support structure and inclined at an upward angle relative to horizontal as taken from the rear to the front of the support structure.

5. The system of claim 4, wherein the angle of inclination is between 6 and 26 degrees from horizontal.

6. The system of claim 1, wherein the internal resistance means further includes:

a turntable connected to each foot plate, a spring actuator attached to each turntable, and a spring adapted to impart resistance to rotation of a corresponding foot plate, rotation of the turntable actuating the spring actuator so as to engage the spring and generate tension.

7. A system adapted to reduce the likelihood of incontinence in a user's body, comprising:

a pair of separate rotational resistance devices arranged in side-by-side relation on a ground surface next to a wall, each device further including a rotatable foot plate thereon and internal resistance means against rotation of the plate therein, each plate adapted so that a user, with a corresponding foot on each device and their back being supported by the wall, performs an exercise to activate selected under active muscles and release selected overactive muscles in and around the pelvic bone so as to strengthen muscular support of the bladder in the user's body.

8. The system of claim 7, wherein muscles activated by the exercise thereon in and around the pelvic bone so as to strengthen muscular support of the bladder include at least one or more of the elevator ani—pubococcygeus (pubovaginalis, puborectalis), iliococcygeus, and coccygeus (ischiococcygeus), and muscles inhibited and released include at least one or more of the piriformis and obturator internus.

9. The system of claim 7, each device further including a support structure on the ground surface, the foot plate serving as the top surface of the support structure and inclined at an upward angle relative to horizontal as taken from the rear to the front of the support structure.

10. A rotational resistance system, comprising:

a pair of separate rotational resistance devices arranged in side-by-side relation on a ground surface next to a wall, each device further including a rotatable foot plate thereon and internal resistance means therein for providing resistance and release of resistance against rotation of the plate, each plate adapted so that a user, with a corresponding foot on each device and their back being supported by the wall, performs a squat-type exercise to activate selected under active muscles and release selected overactive muscles.

11. The system of claim 10, wherein a combination of exercise thereon with the user's body in a supported, unloaded position on the devices inherently effects myofascial balance between the under active and overactive muscles.

12. The system of claim 10, wherein muscles activated through the squat-type exercise include at least one or more of the tibialis anterior, tibialis posterior, and peroneus longus muscles, and muscles and tendons released include at least one or more of the gastrocnemius and soleus muscles, and the Achilles tendon.

13. The system of claim 10, each device further including a support structure on the ground surface, the foot plate serving as the top surface of the support structure and inclined at an upward angle relative to horizontal as taken from the rear to the front of the support structure.

14. A rotational resistance system, comprising:

a pair of separate rotational resistance devices arranged in side-by-side relation on a ground surface, each device including a rotatable plate connected to a means for providing resistance and release of resistance as a user, with a corresponding hand on each device and in a kneeling position on the ground surface, performs a shoulder rotation exercise to activate selected under active muscles and release selected overactive muscles.

15. The system of claim 14, wherein a combination of exercise thereon with the user's body in an unloaded position on the devices inherently effects myofascial balance between the under active and overactive muscles.

16. The system of claim 14, wherein muscles activated through the shoulder rotation exercise include at least one or more of the rhomboids, infraspinatus, teres minor, posterior deltoid, serratus anterior, lower trapezius, serratus posterior inferior, and pectoralis minor muscles, and muscles released include at least one or more of the latissimus dorsi, subscapularis, teres major, upper trapezius, serratus posterior superior, and pectoralis major muscles.

17. The system of claim 14, each device further including a support structure on the ground surface, the foot plate serving as the top surface of the support structure and inclined at an upward angle relative to horizontal as taken from the rear to the front of the support structure.

18. A rotational resistance system for improving a user's range of motion, comprising:

an elongate member adapted to be held between crossed arms of the user against their chest, a pair of separate rotational resistance devices arranged in opposite facing relation to one another on a ground surface, each device including a rotatable plate connected to a means for providing resistance and release of resistance as a user, holding the member with a corresponding foot on each plate and in a bent knee position with upper body leaning slightly forward at the trunk, performs an exercise based on rotation of their trunk maximally to either direction, with inward foot rotation on each side of rotation, to activate selected under active muscles and release selected overactive muscles, thereby enhancing range of motion.

19. The system of claim 18, each device further including a support structure on the ground surface, the foot plate serving as the top surface of the support structure and inclined at an upward angle relative to horizontal as taken from the rear to the front of the support structure, the lower ends of the inclined plates on corresponding devices arranged in facing relation to each other.

20. A rotational resistance system adapted for a user so as to facilitate exercise of muscles throughout upper and lower extremities of the user's body, comprising:

a pair of separate rotational resistance devices for placement of a corresponding hand or foot of a user thereon, each device further including a support structure, a top surface of which being embodied as a rotatable plate for placing the hand or foot, the plate connected to a means for providing resistance and release of resistance thereto, wherein performance of various exercise protocols by the user with the system activates selected under active muscles of the user and releases selected overactive muscles to inherently effect myofascial balance therebetween.

* * * * *